US010661188B1

(12) United States Patent
Dafoe

(10) Patent No.: US 10,661,188 B1
(45) Date of Patent: May 26, 2020

(54) MODEL TRAIN CAR COUPLER

(71) Applicant: James Dafoe, Picton (CA)

(72) Inventor: James Dafoe, Picton (CA)

( * ) Notice: Subject to any disclaimer, the term of this patent is extended or adjusted under 35 U.S.C. 154(b) by 221 days.

(21) Appl. No.: 15/936,577

(22) Filed: Mar. 27, 2018

(51) Int. Cl.
*A63H 19/18* (2006.01)

(52) U.S. Cl.
CPC ..... *A63H 19/18* (2013.01)

(58) Field of Classification Search
CPC ..... A63H 19/16; A63H 19/18
See application file for complete search history.

(56) References Cited

U.S. PATENT DOCUMENTS 2,102,649 A * 12/1937 Norval ..... A63H 19/18 213/100 R
3,678,618 A * 7/1972 Beny ..... A63H 19/18 213/75 TC
3,939,989 A * 2/1976 Thomson ..... A63H 19/18 213/75 TC
5,316,158 A 5/1994 Dunham
5,620,106 A * 4/1997 Storzek ..... A63H 19/18 213/75 TC
D421,280 S 2/2000 Grubb
6,189,713 B1 2/2001 Oh
6,308,845 B1 * 10/2001 Sergent, IV ..... A63H 19/18 213/75 D
6,994,224 B2 2/2006 Barger
7,694,834 B2 4/2010 Wolf
7,810,660 B1 * 10/2010 Dunham ..... A63H 19/18 213/75 A
8,127,952 B2 3/2012 Grubba
2005/0167386 A1 * 8/2005 Barger ..... A63H 19/18 213/75 TC
2009/0014402 A1 * 1/2009 Wolf ..... A63H 19/18 213/75 TC
2009/0114614 A1 * 5/2009 Dudley ..... A63H 19/18 213/75 TC
2011/0253664 A1 * 10/2011 Grubba ..... A63H 19/18 213/75 TC

FOREIGN PATENT DOCUMENTS

WO 2005070710 8/2005

* cited by examiner

*Primary Examiner* — Jason C Smith
(74) *Attorney, Agent, or Firm* — Kyle A. Fletcher, Esq.

(57) ABSTRACT

The model train car coupler comprises a coupler body and a pivoting knuckle. The model train car coupler body resembles a Janney coupler reduced to the scale of a model train. The model train car coupler is used on one or both the ends of a model train locomotive, caboose, or train car to couple one car to an adjacent car. The model train car coupler is used by backing a train car having the coupler into another car also having the coupler. As the cars are pushed together, the pivoting knuckles of each coupler defect to opposite sides, pass each other, and then spring back to their original positions at which point the couplers are engaged and forward motion of the train will cause one car to pull the other forward.

15 Claims, 4 Drawing Sheets

MODEL TRAIN CAR COUPLER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of model railroading, more specifically, a model train car coupler.

SUMMARY OF INVENTION

The model train car coupler comprises a coupler body and a pivoting knuckle. The model train car coupler body resembles a Janney coupler reduced to the scale of a model train. The model train car coupler is used on one or both the ends of a model train locomotive, caboose, or train car to couple one car to an adjacent car. The model train car coupler is used by backing a train car having the coupler into another car also having the coupler. As the cars are pushed together, the pivoting knuckles of each coupler defect to opposite sides, pass each other, and then spring back to their original positions at which point the couplers are engaged and forward motion of the train will cause one car to pull the other forward.

An object of the invention is to provide a realistic looking train car coupler for use on model railroads.

Another object of the invention is to provide a pivoting knuckle on the coupler, which deflect when a pair of couplers are pushed against each other.

A further object of the invention is to provide a hooked portion of the pivoting knuckle shaped to deflect during coupling.

Yet another object of the invention is to provide a pivoting knuckle that engages with another pivoting knuckle to pull an adjacent car when train motion tries to separate a pair of the couplers attached to adjacent cars.

These together with additional objects, features and advantages of the model train car coupler will be readily apparent to those of ordinary skill in the art upon reading the following detailed description of the presently preferred, but nonetheless illustrative, embodiments when taken in conjunction with the accompanying drawings.

In this respect, before explaining the current embodiments of the model train car coupler in detail, it is to be understood that the model train car coupler is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the model train car coupler.

It is therefore important that the claims be regarded as including such equivalent construction insofar as they do not depart from the spirit and scope of the model train car coupler. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
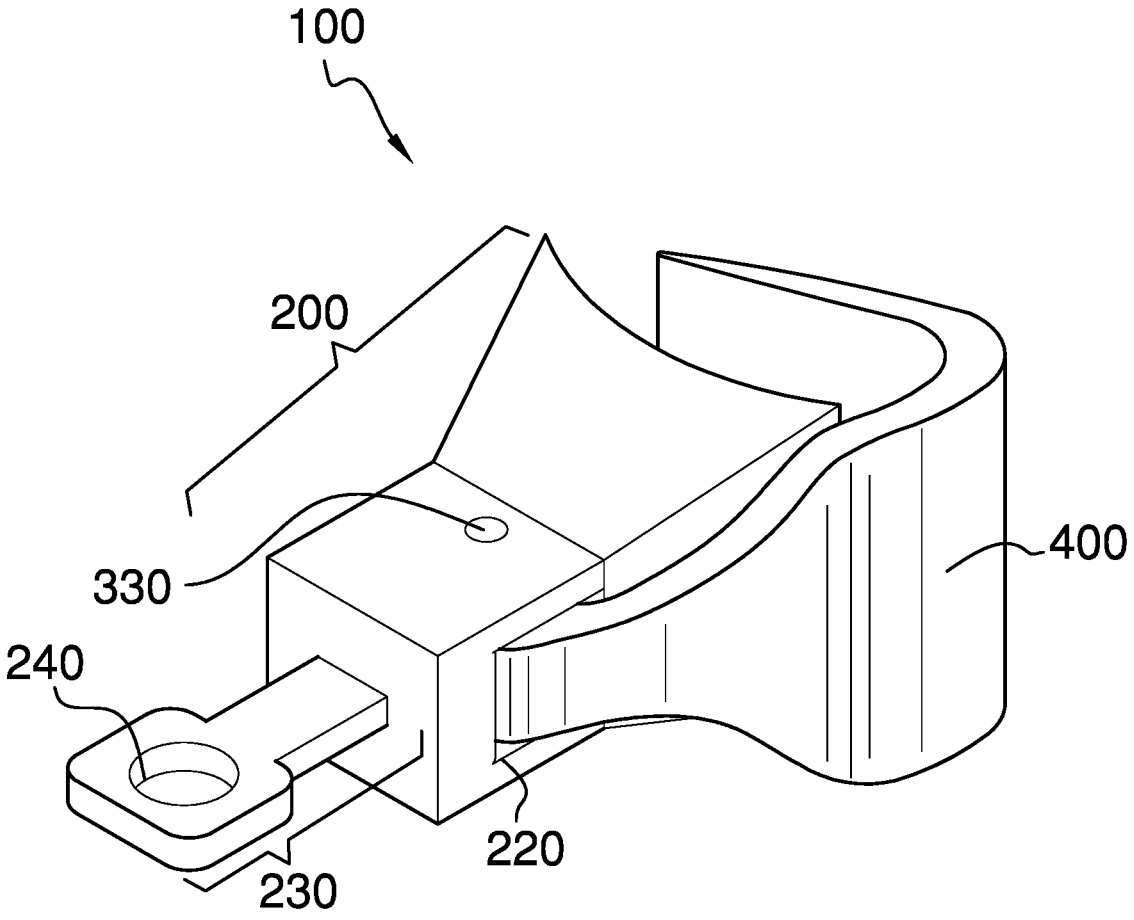
FIG. 1 is a perspective view of an embodiment of the disclosure.
Figure 2:
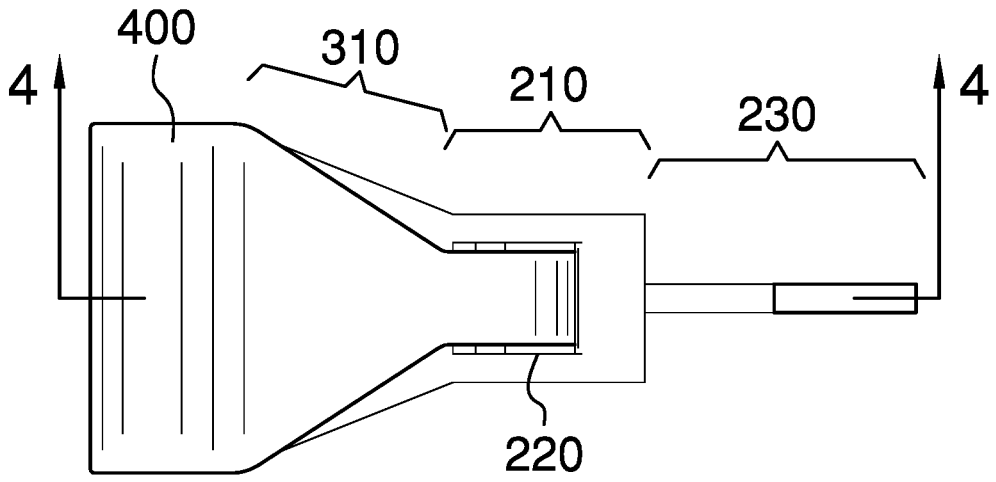
FIG. 2 is a side view of an embodiment of the disclosure.
Figure 3:
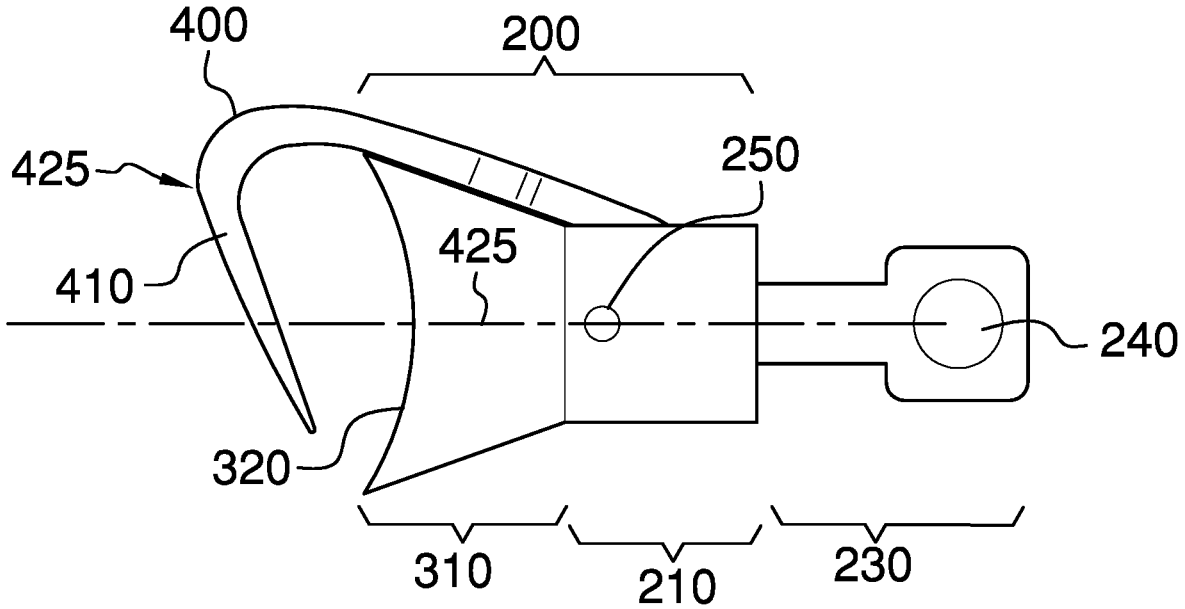
FIG. 3 is a top view of an embodiment of the disclosure.
Figure 4:
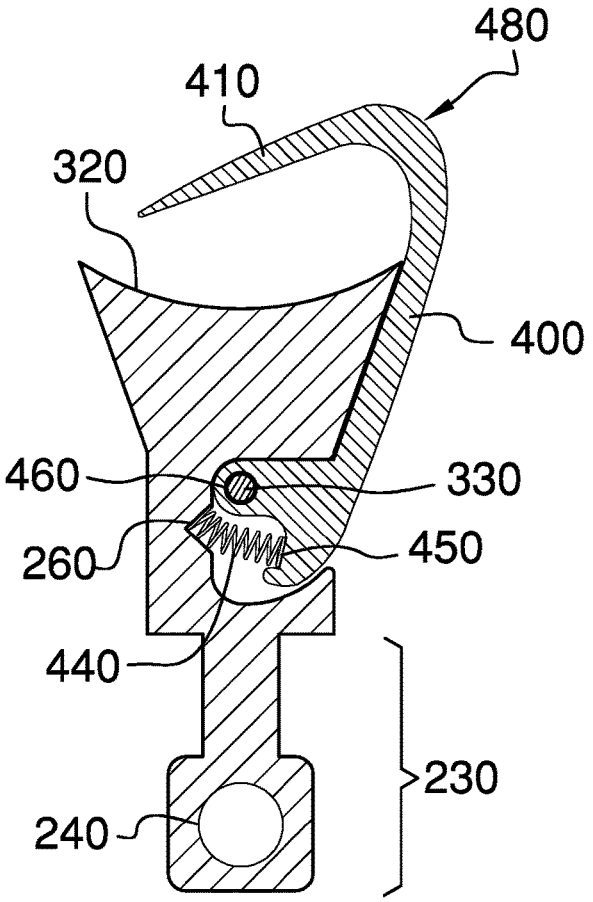
FIG. 4 is a cross-sectional view of an embodiment of the disclosure across 4-4 as shown in FIG. 2 when the pivoting knuckle is in the original position.
Figure 5:
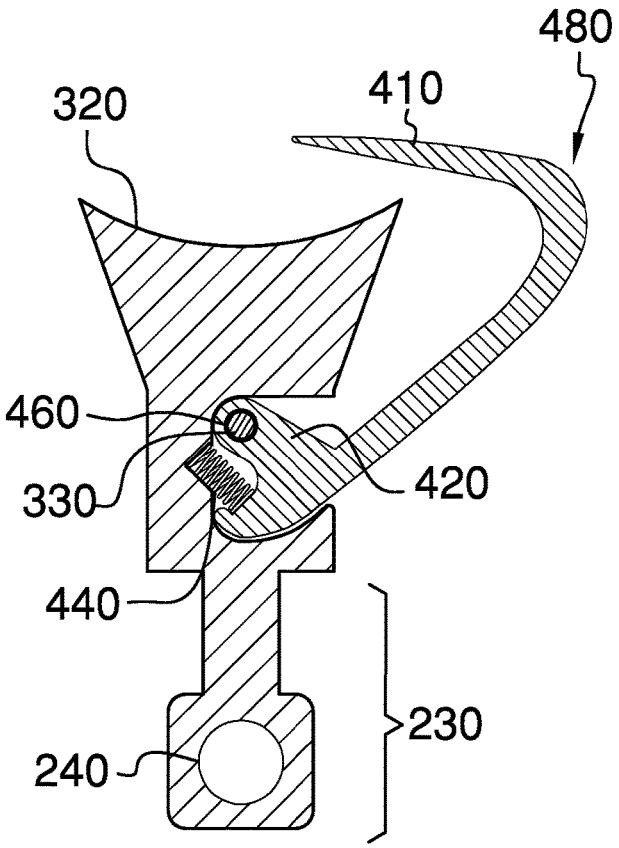
FIG. 5 is a cross-sectional view of an embodiment of the disclosure as shown in FIG. 4, with the pivoting knuckle moved to the deflected position.
Figure 6:
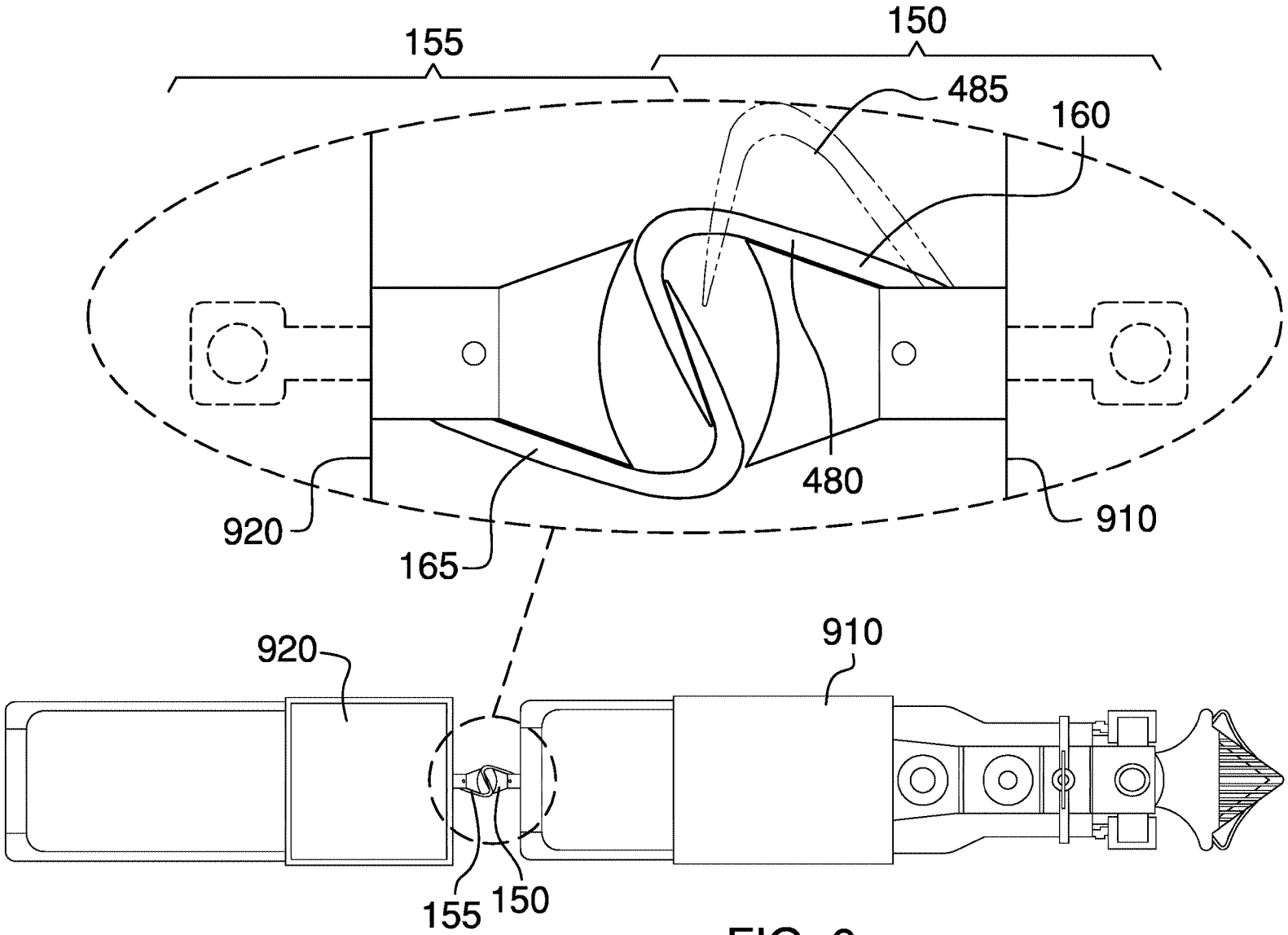
FIG. 6 is an in-use view of an embodiment of the disclosure showing two cars coupled using the invention.

Detailed reference will now be made to a first potential embodiment of the disclosure, which is illustrated in FIGS. 1 through 6.

The model train car coupler 100 (hereinafter invention) comprises a coupler body 200 and a pivoting knuckle 400. The invention 100 may mount onto the end of a model railroad car and may be used in pairs to couple a first model railroad car 910 to a second model railroad car 920.

When a first model train car coupler 150 on the first model railroad car 910 and a second model train car coupler 155 on the second model railroad car 920 are pushed together from opposing directions, a first pivoting knuckle 160 on the first model train car coupler 150 and a second pivoting knuckle 165 on the second model train car coupler 155 may deflect from their original positions 480. When the first pivoting knuckle 160 and the second pivoting knuckle 165 are in their deflected positions 485 they may pass each other. Once past each other, the first pivoting knuckle 160 and the second pivoting knuckle 165 may return to the original positions 480. When the first pivoting knuckle 160 and the second pivoting knuckle 165 are in the original positions 480, they are coupled and reversing the direction of travel on either car will result in the interlocking of the pivoting knuckles 400 with the first model railroad car 910 pulling the second model railroad car 920, or vice versa.

Throughout this disclosure, directions are specified using a gravitational frame of reference and looking from the model railroad car towards the invention 100. Down is the direction that gravity pulls an object; up is the opposite of down. The front of the invention 100 is defined to be the side of the invention 100 where a mounting tab 230 is located and rear or back is the opposite side from the front. Looking from the front side of the invention 100, which is the mounting tab 230 side of the invention 100, right is on the observer's right and left is the side opposite from the right. The pivoting knuckle 400 emerges from a neck 210 on the right side of the neck 210.

The coupler body 200 may be mounted onto the model railroad car. The coupler body 200 comprises the neck 210, a head 310, and the mounting tab 230. The neck 210 may be a rectangular cuboid. One side of the neck 210 may be coupled to the mounting tab 230 and the opposing side may be coupled to the head 310.

The head 310 may be pyramidal in shape with the apex of the pyramid truncated. The base of the pyramid may comprise a concave surface 320 in one dimension. The pyramid may be rotated 90 degrees such that the concave surface 320 is apparent when the head 310 is viewed from above. The truncated apex of the pyramid may be coupled to the neck 210 on the side of the neck 210 opposite the mounting tab 230. The concave surface 320 provides utility when the model railroad cars turn on a curved track (not illustrated in the figures). Specifically, when the first model train car coupler 150 on the first model railroad car 910 is pulling the second model train car coupler 155 on the second model railroad car 920 around the curved track, the angle formed by a longitudinal axis 425 of the first model train car coupler 150 and the longitudinal axis 425 of the second model train car coupler 155 changes. The concave surface 320 on the first model train car coupler 150 and on the second model train car coupler 155 gives clearance for the pivoting knuckle 400 on the opposing coupler to pivot during the turn.

The mounting tab 230 may be a projection of the coupler body 200 towards the center of the model railroad car. The mounting tab 230 may comprise a mounting aperture 240 which may be used to mount the coupler body 200 to the model railroad car. As a non-limiting example, a screw or bolt passed through the mounting aperture 240 may be used to mount the coupler body 200 to the model railroad car. The pivoting knuckle 400 may pivotally couple to the coupler body 200.

The neck 210 comprises a slot 220, a first spring mount 260, and a body pivot aperture 250. The slot 220 may be an aperture on the right side of the neck 210. The slot 220 may be oriented horizontally and may run from a midpoint of the right side of the neck 210 to the rear of the neck 210. The slot 220 may be at least as wide as the thickness of an internal flange 420 on the pivoting knuckle 400. The internal flange 420 may reside within the slot 220. As the pivoting knuckle 400 pivots on a pivot pin 330, the internal flange 420 may move within the slot 220.

The first spring mount 260 may be coupled to one end of a spring 440. The other end of the spring 440 may be coupled to a second spring mount 450 located on the pivoting knuckle 400. The spring 440 may be used to push the pivoting knuckle 400 away from the neck 210 in such a way that the pivoting knuckle 400 is forced to move to the original position 480.

The body pivot aperture 250 may be a vertical hole in the top surface of the neck 210. The body pivot aperture 250 may extended downwards from the top surface of the neck 210 at least as far as the slot 220. The diameter of the body pivot aperture 250 may be at least as large as the diameter of the pivot pin 330. The pivot pin 330 pushed into the body pivot aperture 250 from the top of the neck 210 may pass through the neck 210 and through the internal flange 420 on the pivoting knuckle 400 and may pivotally couple the internal flange 420 to the neck 210.

The pivoting knuckle 400 comprises a hook 410, the internal flange 420, and the spring 440. The hook 410 may be an armature that resembles a fish hook when viewed from above. The top-to-bottom thickness of the hook 410 varies from the thickness of the internal flange 420 at the front of the hook 410 to the thickness of the head 310 at the rear of the hook 410.

The rear, left tip of the hook 410 is shaped such that when two of the pivoting knuckles 400 are pushed towards each other from opposing directions, the hook 410 will move to the right on both of the pivoting knuckles 400. Specifically, when the pivoting knuckle 400 is in the original position 480, the hook 410 bends towards a front-pointing direction beginning at a point of maximum rearward extension 415 which is a point to the right of the longitudinal axis 425 of the invention 100. By doing so, the hook 410 presents a ramp that may force the hook 410 to move to towards the right when longitudinal force from another the pivoting knuckle 400 is applied to the rear of the hook 410.

The internal flange 420 may be a leftward extension of the front of the hook 410 that couples the pivoting knuckle 400 to the coupler body 200. The internal flange 420 comprises a knuckle pivot aperture 460 and the second spring mount 450. The knuckle pivot aperture 460 may be an aperture through which the pivot pin 330 passes to provide a pivot point for the pivoting knuckle 400. The diameter of the knuckle pivot aperture 460 may be at least as large as the diameter of the pivot pin 330.

The second spring mount 450 may be a coupling point for the spring 440. The second spring mount 450 may be located on the internal flange 420 in front of the knuckle pivot aperture 460. Pressure from the spring 440 pushing outwards on the internal flange 420 may cause the pivoting knuckle 400 to pivot and may force the hook 410 to move towards the longitudinal axis 425.

In use, the invention 100 is mounted onto the bottom of a plurality of the model railroad cars. In general, each of the model railroad cars will use two of the inventions 100—one at each end of the model railroad car. Notable exceptions may be the locomotive and the caboose, which may only have the invention 100 mounted at one end. A train may back slowly into another the model railroad car to engage the couplers. As the first model railroad car 910, which is the last car coupled to the train, is backed into the second model railroad car 920, the pivoting knuckles 400 on both of the model railroad cars may deflect to move out of the way and allow the train to continue backing up. When the pivoting knuckles 400 have passed each other, the spring 440 inside of each the coupler bodies 200 will push the pivoting knuckles 400 back to the original positions 480. If the travel direction of the locomotive is then reversed, the first model railroad car 910 will pull the second model railroad car 920 because the hook 410 of each the pivoting knuckle 400 will be interlocked.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, an "apex" is the point of an object that has the greatest height, altitude, or distance relative to a given reference.

As used in this disclosure, "concave" is used to describe a surface that resembles the interior surface of a sphere or a portion thereof.

As used herein, the words "couple", "couples", "coupled" or "coupling", refer to connecting, either directly or indirectly, and does not necessarily imply a mechanical connection.

As used in this disclosure, a "diameter" of an object is a straight line segment that passes through the center (or center axis) of an object. The line segment of the diameter is terminated at the perimeter or boundary of the object through which the line segment of the diameter runs.

As used in this disclosure, a "flange" is a protruding rib, edge, or collar that is used to hold an object in place or to attach a first object to a second object.

As used herein, "front" indicates the side of an object that is closest to a forward direction of travel under normal use of the object or the side or part of an object that normally presents itself to view or that is normally used first. "Rear" or "back" refers to the side that is opposite the front.

As used herein, the word "longitudinal" or "longitudinally" refers to a lengthwise or longest direction.

As used here, the word "midpoint" refers to a point near the center of an object. An "exact midpoint" refers to a midpoint that is equidistant from edges of the object in at least one direction. Unless otherwise stated, a midpoint is not required to be at the exact center of the object but instead may be within 20% of the distance from the exact midpoint to the farthest edge.

As used herein, the word "pivot" is intended to include any mechanical arrangement that allows for rotational motion. Non-limiting examples of pivots may include hinges, holes, posts, dowels, pins, points, rods, shafts, balls, and sockets, either individually or in combination.

As used in this disclosure, a "pyramid" is a three dimensional shape that comprises a base formed in the shape of an N-gon (wherein N is an integer) with N triangular faces that rise from the base to meet at a point above the base. If the point where the N faces meet is positioned such that a line drawn from the point where the N faces meet to the center of the N-gon base is perpendicular to the N-gon base, the pyramid is referred to as a right pyramid. Pyramids can be further formed with circular or elliptical bases, which are commonly referred to as cone or an elliptical pyramid respectively. As used in this disclosure, an "N-gon" is a regular polygon with N sides wherein N is a positive integer number greater than 2.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, a "track" is a device that is used to control the path of motion of an object in at least one dimension.

As used in this disclosure, a geometric object is "truncated" when an apex, vertex, or end is cut off by a line or plane.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A model train car coupler comprising:

a coupler body and a pivoting knuckle;

wherein the model train car coupler is used in pairs to couple a first model railroad car to a second model railroad car;

wherein the coupler body is mounted onto a model railroad car;

wherein when a first model train car coupler on the first model railroad car and a second model train car coupler on the second model railroad car are pushed together from opposing directions, a first pivoting knuckle on the first model train car coupler and a second pivoting knuckle on the second model train car coupler deflect, in opposite directions, from their original positions;

wherein when the first pivoting knuckle and the second pivoting knuckle are in their deflected positions they pass each other;

wherein once past each other, the first pivoting knuckle and the second pivoting knuckle return to the original positions;

wherein when the first pivoting knuckle and the second pivoting knuckle are in the original positions, they are coupled and reversing the direction of travel on either car will result in the interlocking of the pivoting knuckles with the first model railroad car pulling the second model railroad car, or vice versa;

wherein the coupler body comprises a neck, a head, and a mounting tab;

wherein the neck is a rectangular cuboid;

wherein one side of the neck is coupled to the mounting tab and the opposing side is coupled to the head;

wherein the head is pyramidal in shape with the apex of the pyramid truncated;

wherein the base of the pyramid comprises a concave surface in one dimension;

wherein the pyramid is rotated 90 degrees such that the concave surface is apparent when the head is viewed from above.

2. The model train car coupler according to claim 1 wherein the truncated apex of the pyramid is coupled to the neck on the side of the neck opposite the mounting tab;

wherein the concave surface provides utility when the model railroad cars turn on a curved track.

3. The model train car coupler according to claim 2 wherein the mounting tab is a projection of the coupler body towards the center of the model railroad car;

wherein the mounting tab comprises a mounting aperture which is used to mount the coupler body to the model railroad car;

wherein the pivoting knuckle pivotally couples to the coupler body.

4. The model train car coupler according to claim 3 wherein the neck comprises a slot, a first spring mount, and a body pivot aperture;

wherein the slot is an aperture on the right side of the neck.

5. The model train car coupler according to claim 4 wherein the slot is oriented horizontally and runs from a midpoint of the right side of the neck to the rear of the neck;

wherein the slot is at least as wide as the thickness of an internal flange on the pivoting knuckle.

6. The model train car coupler according to claim 5 wherein the internal flange resides within the slot;

wherein as the pivoting knuckle pivots on a pivot pin, the internal flange moves within the slot.

7. The model train car coupler according to claim 6 wherein the first spring mount is coupled to one end of a spring;

wherein the other end of the spring is coupled to a second spring mount located on the pivoting knuckle.

8. The model train car coupler according to claim 7 wherein the spring pushes the pivoting knuckle away from the neck in such a way that the pivoting knuckle is forced to move to the original position.

9. The model train car coupler according to claim 8 wherein the body pivot aperture is a vertical hole in the top surface of the neck;

wherein the body pivot aperture extends downwards from the top surface of the neck at least as far as the slot;

wherein the diameter of the body pivot aperture is at least as large as the diameter of the pivot pin.

10. The model train car coupler according to claim 9 wherein the pivot pin is pushed into the body pivot aperture from the top of the neck, passes through the neck and through the internal flange on the pivoting knuckle, and pivotally couples the internal flange to the neck.

11. The model train car coupler according to claim 10 wherein the pivoting knuckle comprises a hook, the internal flange, and the spring;

wherein the hook is an armature that resembles a fish hook when viewed from above;

wherein the top-to-bottom thickness of the hook varies from the thickness of the internal flange at the front of the hook to the thickness of the head at the rear of the hook.

12. The model train car coupler according to claim 11 wherein the rear, left tip of the hook is shaped such that when two of the pivoting knuckles are pushed towards each other from opposing directions, the hook will move to the right on both of the pivoting knuckles;

wherein when the pivoting knuckle is in the original position, the hook bends towards a front-pointing direction beginning at a point of maximum rearward extension which is a point to the right of a longitudinal axis of the model train car coupler.

13. The model train car coupler according to claim 12 wherein the internal flange is a leftward extension of the front of the hook that couples the pivoting knuckle to the coupler body the internal flange comprises a knuckle pivot aperture and the second spring mount.

14. The model train car coupler according to claim 13 wherein the knuckle pivot aperture is an aperture through which the pivot pin passes to provide a pivot point for the pivoting knuckle;

wherein the diameter of the knuckle pivot aperture is at least as large as the diameter of the pivot pin.

15. The model train car coupler according to claim 14 wherein the second spring mount is a coupling point for the spring;

wherein the second spring mount is located on the internal flange in front of the knuckle pivot aperture;

wherein pressure from the spring pushing outwards on the internal flange causes the pivoting knuckle to pivot and forces the hook to move towards the longitudinal axis.

* * * * *